US005183253A

United States Patent [19]

Grimaldi et al.

[11] Patent Number: 5,183,253

[45] Date of Patent: Feb. 2, 1993

[54] BASKETBALL RETRIEVAL AND RETURN DEVICE

[76] Inventors: Anthony J. Grimaldi, 25 Mountain View Ave., Kingston, N.Y. 12401; Anthony J. Grimaldi, Jr., 6 Holly Blvd., Scotia, N.Y. 12302

[21] Appl. No.: 634,597

[22] Filed: Dec. 27, 1990

[51] Int. Cl.[5] ..... A63B 69/00

[52] U.S. Cl. ..... 273/1.5 A; 273/397

[58] Field of Search ..... 273/1.5 A, 395-397

[56] References Cited

U.S. PATENT DOCUMENTS

| | | | |
|---|---|---|---|
| 4,667,957 | 5/1987 | Joseph | 273/1.5 A |
| 4,786,371 | 11/1988 | Postol | 273/1.5 A |
| 4,838,549 | 6/1989 | Woodall | 273/1.5 A |
| 5,016,875 | 5/1991 | Joseph | 273/1.5 A |

FOREIGN PATENT DOCUMENTS

| | | | |
|---|---|---|---|
| 919721 | 1/1973 | Canada | 273/396 |
| 1319878 | 6/1987 | U.S.S.R. | 273/1.5 A |

OTHER PUBLICATIONS

Korney Board Aids, Basketball Coaching & Training Aids, 1989 School Mail Order Catalog, Dec. 1988 p. 12, Shoot-A-Way.

*Primary Examiner*—Paul E. Shapiro

[57] ABSTRACT

A basketball retrieval and return device for use as a teaching device with a conventional basketball goal and conventional basketballs which randomly directs the returned basket-balls to a group of players circled about the basketball goal, the distance of the players from the goal being variable to permit the players to practice the three-point play.

2 Claims, 3 Drawing Sheets

BASKETBALL RETRIEVAL AND RETURN DEVICE

BACKGROUND OF THE INVENTION

This invention relates to an apparatus for practicing the sport of basketball. It is an improvement to numerous ball return devices and more specifically permits players to practice efficiently the three-point play which provides three points for placing the basketball in the basket when thrown from a specified distance from the basket.

It is well known in the game of basketball that the players in playing the game each attempt to throw the basketball in such a manner as to pass the basketball through an annular member secured to a backboard at each end of the court. Each of the annular members have a net extending downward from them. The annular member together with its generally required net is commonly referred to in the game as the basket. It is imperative for basketball players to practice placing a basketball into the basket and it is common for teams to stand in a generally simi-circular position around the basket and to practice with a plurality of basketballs the skill of throwing the basketballs into the basket.

In high school games, there is a designated distance from the basket that is used and in college a greater distance is used, and likewise, in professional basketball, even a further distance is used for the three-point scoring. A device which quickly and efficiently returns the basketballs to the various players is highly desirable while permitting adjustment to the desired distance from the basket depending upon the status and skill of the players.

In the prior art, numerous devices, some more efficient than others, provided a basketball return, but generally for a single player. It is a function of this improvement to provide a basketball retrieval system which may not only be used for one player, but may be used for a plurality of players, using a plurality of basketballs. The basketball retrieval and return device in accordance with this invention, permits a random sorting of the basketballs being thrown into and around the basket and the return of the basketballs to various areas of the standing positions of the players so that the basketballs are available in a continuous sequence for all of the players standing about the goal.

In this way, an entire team can practice together at the art of throwing basketballs into the basket and the development of three-point scoring without need to have someone recover the basketballs and deliver the basketballs to the various players providing maximum efficiency in the time used in developing skills in the sport of basketball.

The device can be very simply made, can be easily taken down and reassembled and transported for use at various locations.

The benefits and improved function and exceptional economy of production as well as ease of handling are provided by this invention.

SUMMARY OF THE INVENTION

It is an object of this invention to provide a basketball retrieval and return device for use in practicing tossing a ball into a basket for the game of basketball and may be used by an individual player or an entire team.

The basketball retrieval and return device is used with a conventional basketball goal and conventional basketballs and a retriever in the shape of a funnel defining an enlarged upward opening. A frame is used to support the retriever. A plurality of downward openings are located in the retriever. A plurality of ball return conveyers are connected to the plurality of downward openings. Preferably, a divider is located in the retriever to direct at ramdom various basketballs to different ones of the plurality of downward openings.

The retrieval and return device is easily assembled and easily dismantled and can be stored compactly without doing any damage or in any way interfering with the standard basketball backboard and basket on a basketball court.

The novel features which are considered as characteristics of the invention are set forth with particularity in the appended claims. The invention itself, however, as to its construction and obvious advantages will be best understood from the following description and specific embodiment when read with accompanying drawings.

BRIEF DESCRIPTION OF THE DRAWINGS

Similar reference characters refer to similar parts throughout the several views of the drawings.

DESCRIPTION OF THE PREFERRED EMBODIMENT

Figure 1:
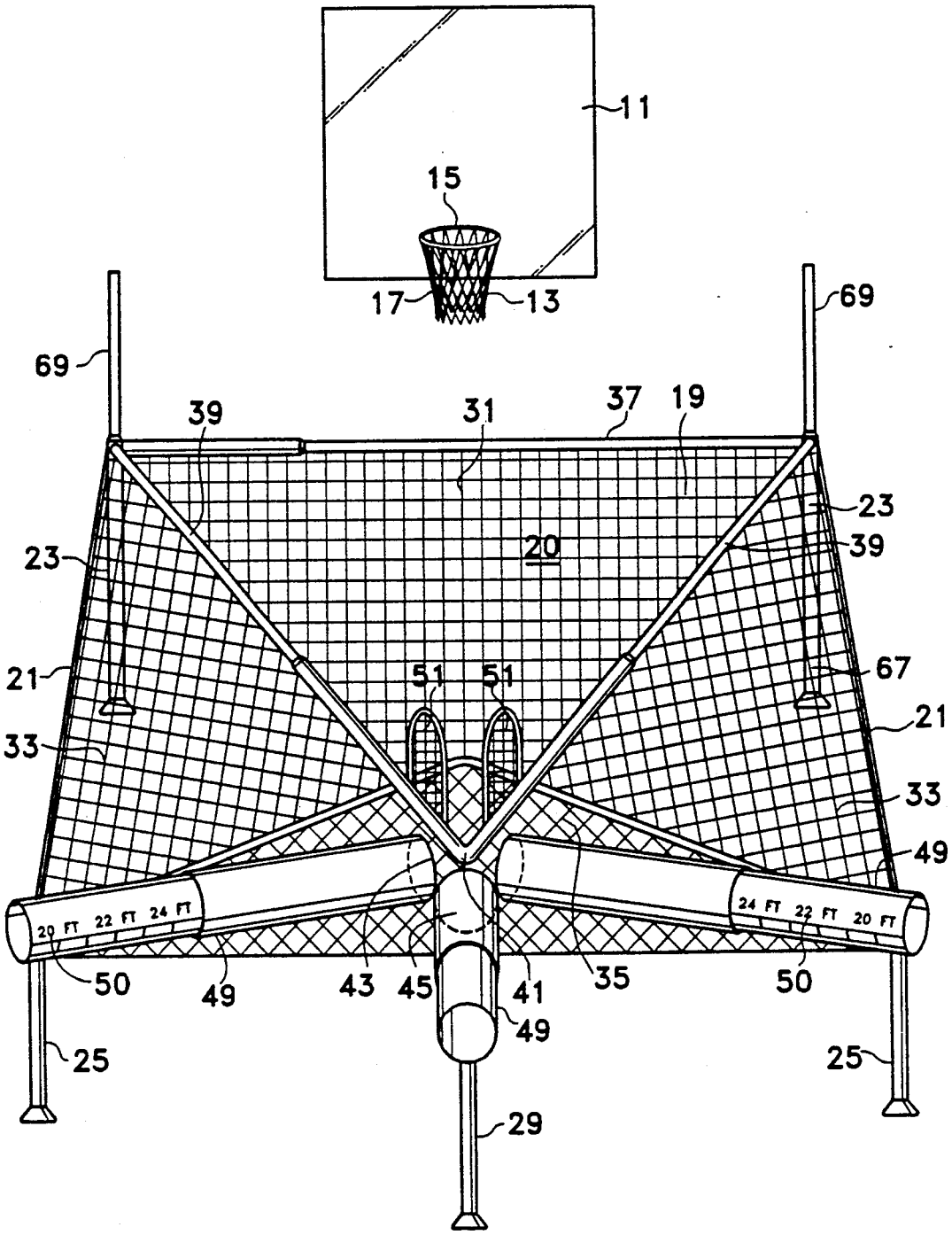
FIG. 1 shows a front elevation of a well-known backboard and basket as used in the game of basketball and which is normally located at one end of a basketball court with the basketball retrieval and return device placed under and forward of the basket with three discharge ball return conveyers in place extending to various segments of the area where a plurality of players would stand to practice throwing basketballs through the basket.

Referring now to FIG. 1, the well-recognized basketball backboard 11 with the basket 13 in the form of an annular member 15 with a net 17 hanging beneath it is shown. Such a device is normally found at one end of a basketball court. Beneath the basket 13 and backboard 11 is shown the basketball retrieval and return device in place.

The basic means for recovering basketballs, whether or not such basketballs actually pass through the basket 13, providing such basketballs come within a general vicinity of the basket, is a retriever 19 in the general shape of a funnel of netting 20. The net or netting 20 is held by a frame 21 including two rear vertical supports 23 two side vertical supports 25, a center vertical support 27 and a forward vertical support 29. The net 20 is held in place by the frame 21 to form a rear wall 31, two side walls 33 and a front wall 35. The two side walls 33 and rear wall 31 of the net 20 slope inwardly and forwardly to the front wall 35. A rear horizontal support bar 37 is connected horizontally between the two rear vertical supports 23 which are generally vertically oriented. Two side sloping supports 39 extend downwardly from the two rear vertical supports 23 to the center vertical support 27 where the two side sloping supports 39 join together at their forward ends at a juncture point 41. Just beneath the juncture point 41, there are three openings 43 in the netting 20 of the retriever at the front wall 35 for discharge of the balls, the center opening 45 being for discharge in a direct forward position and two side openings 47 for discharge at an angle to the direct forward position. Three separate basketball return conveyers 49 are affixed to and extend from each of the three openings 43. The central vertical support 27, supports the end of all of the basketball return conveyers 49. The opposite ends of the basketball return conveyers 49 are supported by either one of the two side vertical supports 25 or the forward vertical support 29. Each of the ball return conveyers 49 are preferably made in a telescopic manner with one section slidably fitted within another to provide for extending and shortening the length of each of the basketball return conveyers 49. Numerals 50 printed on the ball return conveyers 49 indicates the length basketball return of the conveyers for easy set up for the various distances required by players of varying status and skill. A fifteen foot to thirty foot range provides adequate flexibility for practice tossing of the basketball into the basket, particularly for the three-point play which provides extra points for a basketball placed in the basket from a specified distance, such distance depending upon the status of the team such as High School, College, or professional.

The telescopic design also assists in dismantaling and storing the basketball return conveyers. At the end of each conveyer a stop is located so the basketballs stay on the basketball return conveyers until picked up by the players. It is also possible to block off one or more of the openings 43 in the net 20 by any suitable means such as a net flap 51 just tied in place so that only one basketball return conveyer 49 will operate or even need be put in place.

The frame 29 is also preferably made telescopic to provide means for adjusting the tension in the net 20 and also for easy dismantling and storage of the device.

Figure 4:
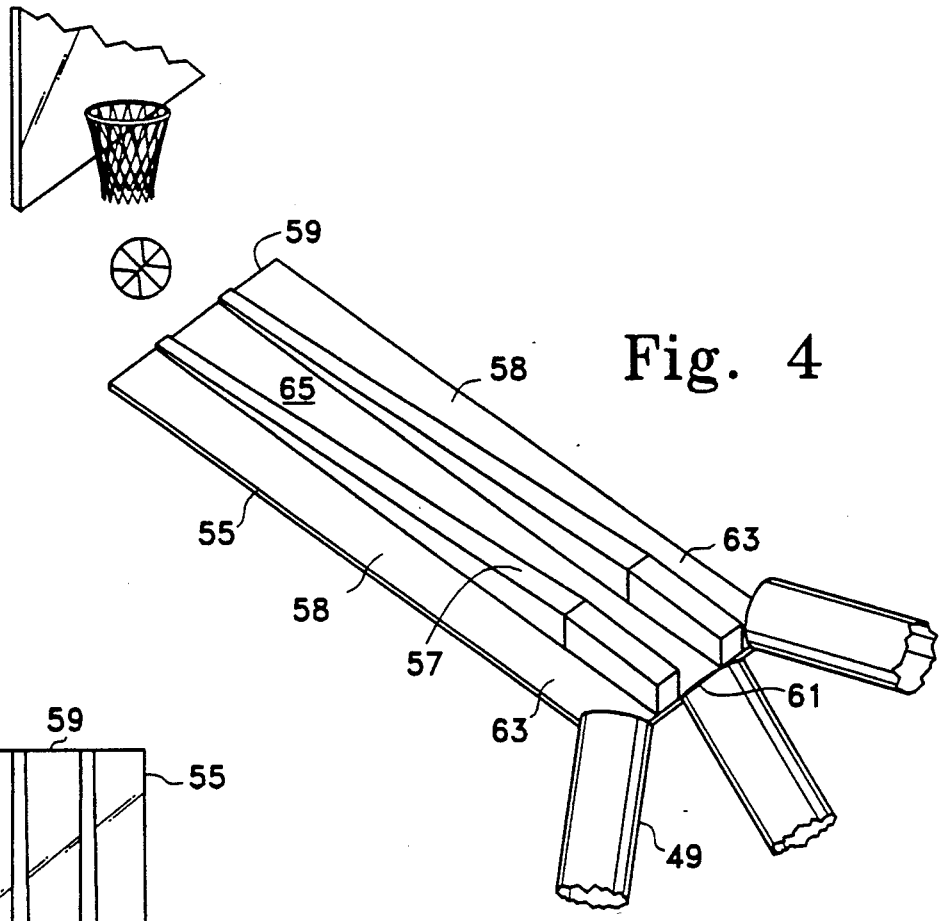
FIG. 4 is a pictorial view of the same divider shown in FIG. 3 and also showing the basket with a basketball passing through the device and heading into the divider.
Figure 3:
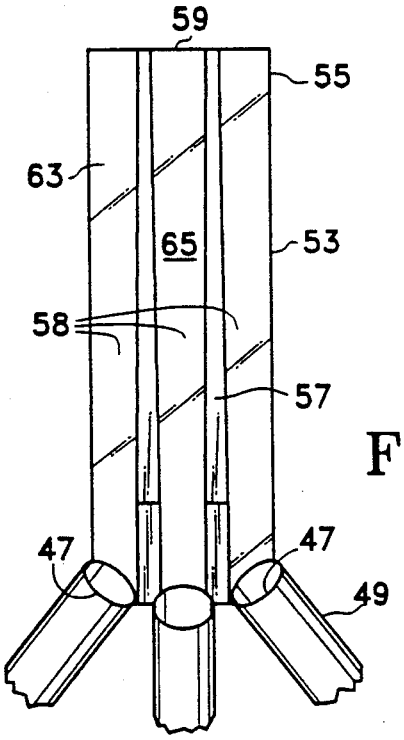
FIG. 3 is a top plan view of a divider you use in the retrieval and return device and with two partitions for forming channels for separating at random the returning basketballs within the device and randomly directing such basketballs to the various ball return conveyers.
Figure 5:
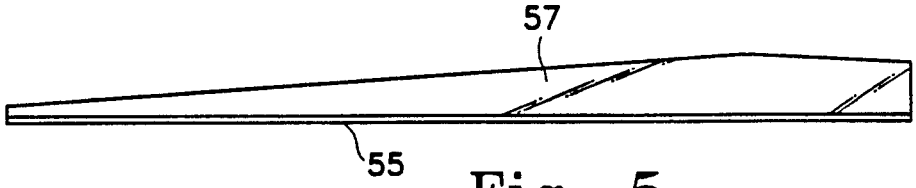
FIG. 5 is a side elevation of the same divider shown in FIGS. 3 and 4 and showing the sloping of the partitions used to create a plurality of channels for randomly separating the returning basketballs to various basketball conveyers.

As best seen in the FIGS. 3, 4, and 5, a divider 53 is provided for use in the retriever 19 and is connected firmly to the net 20 so as to leave no space between the net 20 of the retriever 19 and the net 20. The divider 53 is aligned directly at right angles to the rear horizontal support 37 and to the backboard 11 and is placed in a sloping direction forwardly and downwardly and in direct communication with the three openings 43. If more or less than three openings 43 are desired, the divider 53 is increased and decreased accordingly.

The divider consists of a flat base plate 55 which can be made from any suitable material such as rubber or plastic with partitions 57 vertically located at right angles to the base plate 55 and equally spaced from one another on the baseplate 55 there are channels 58 for passage of basketballs.

The divider 53 has an upper end 59 located remotely from the openings 43 and a lower end 61 directly connected to the openings 43. The upper end 59 must be raised above the lower end 61, but the net 20 is held in the frame 21 to slope in that direction as previously stated. Each partition 57 is tapered so as to be the thickest and highest at the lower end 61 of the divider 53 so that the channels 58 become narrower and lift the basketballs slightly from the flat baseplate 55, but the path of the basket-ball is always downwardly. Each channel 58 opens into a separate one of the openings 43 and therefore supplies basketballs to a separate basketball return conveyer 49. With the three openings 43, two partitions 57, are used forming three channels 58. There are two side channels 63 located on the sides of the flat base-plate 55 which can receive basketballs anywhere along the length of those side channels 63 and another central channel 65 which receives basketballs only at its upper end 59.

As the basketballs pass either through or around the basket and into the retriever 19, the basketballs fall randomly into different parts of the retriever 19, but all of the basketballs roll forwardly and inwardly. Those which pass centrally into the retriever 19 as best seen in FIG. 4, will go directly into the center channel 65 formed between the two partitions 57 and most other basketballs entering the retriever 19 will enter the retriever 19 from one side or the other, either because they missed the basket, or because they deviated away from the centerline within the retriever and will eventually enter one of two side channels 63. The basketball return conveyers 49 may be turned and moved as to that angle providing the greatest convenience of the players depending on the number of players and may also be extended and shortened depening upon the desired distance the players intend to stand from the goal.

Figure 2:
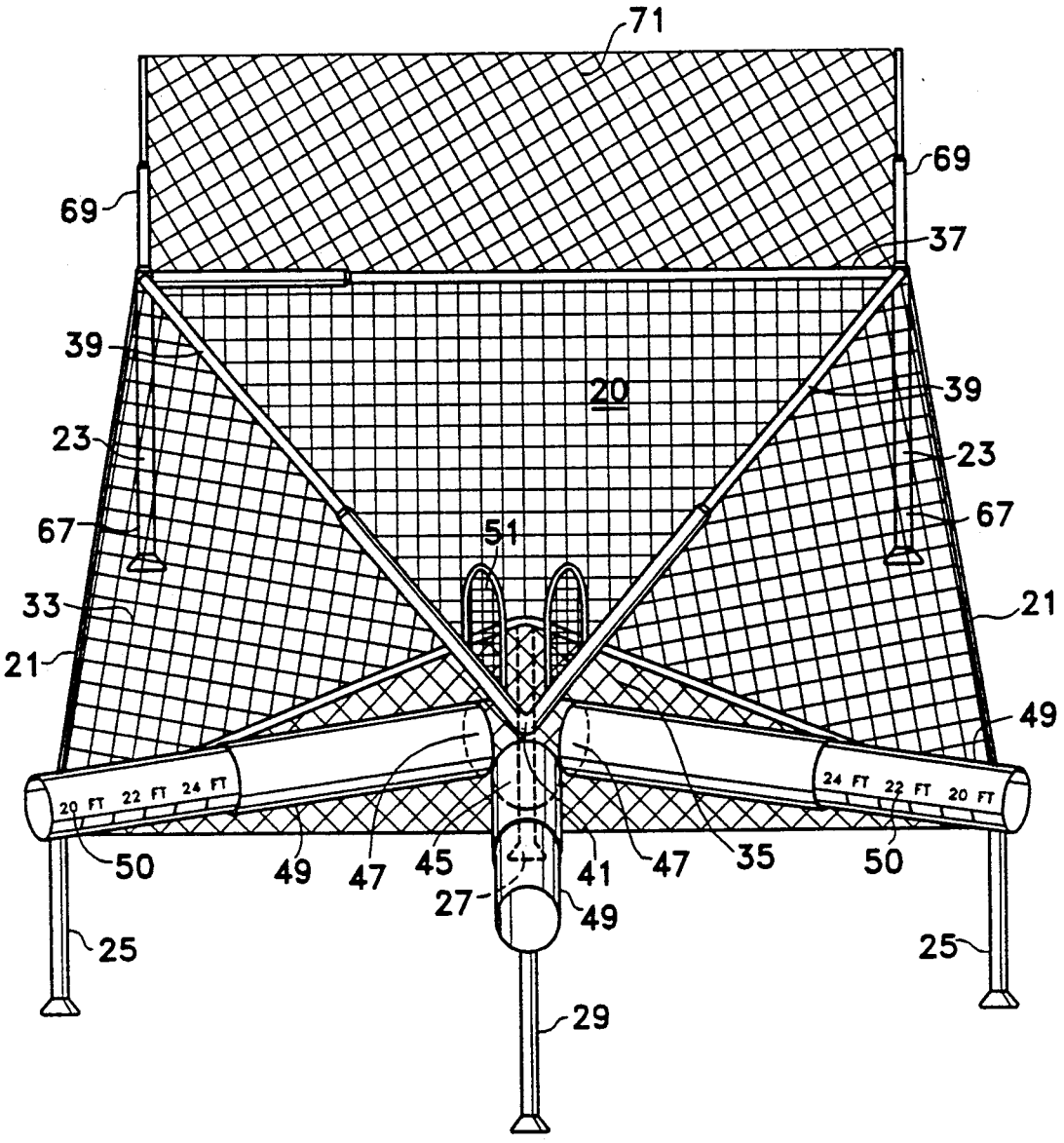
FIG. 2 is a front elevation without the basket and backboard shown and with the ball return conveyers foreshortened, but further showing a back net to assist balls thrown behind the backboard to enter the device.

As best seen in FIG. 2, the two rear vertical supports 23 have a lower portion 67 and an upper portion 69. The lower portion 67 extends from the floor up to the rear horizontal support bar 37 previously described. The upper portion 69 extends in line with the lower portion 67 above the rear longitudial support bar 37 to a point behind and above the base of the backboard 11. A back net 71 may be placed between the upper portions 69 of the two rear vertical supports 23 so that basket-balls which go behind the backboard 11 are also forced into the retriever 19.

The invention may be embodied in other specific forms without departing from the spirit or essential characteristics thereof. The present embodiments are therefore, to be considered in all aspects as illustrative and not restrictive. The scope of the invention is indicated by the appending claims rather than the foregoing description and all changes which come within the meaning and range of equivalency of the claims are therefore intended to be embraced therein.

We claim:

1. A basketball retrieval and return device for use with a conventional basketball goal including a backboard with a base and a basket, the backboard having a side behind the basket, and conventional basketballs, the device comprising:

a retriever in the shape of a funnel having a front, rear and side walls defining an enlarged upward opening, the rear and side walls being inclined downwardly and inwardly to a plurality of downward openings at the front wall, each downward opening being circular and having a diameter which is greater than the diameter of the conventional basketballs, the retriever being located beneath the basket and backboard;

a frame connected to the retriever to support the retriever, such frame including a pair of rear vertical supports, such frame extending vertically above the rear walls of the retriever and a back net affixed to the rear vertical supports, the back net being extended vertically above the rear wall of the retriever and above the base of the backboard and behind the backboard;

a plurality of ball return conveyers, each ball return conveyer being connected to one of the downward openings, the plurality of ball return conveyers being located at an angle to one another; and means to direct randomly the basketballs to each of the plurality of downward openings, said means including a flat base plate having an upper and a lower end, the upper end being raised above the lower end and a plurality of partitions vertically located at right angles to the base plate and equally spaced from one another to form channels, each partition being tapered so as to be thickest and highest from the flat base plate adjacent to the lower end of the flat baseplate, each channel opening into a separate downward opening.

2. A basketball retrieval and return device according to claim 1 wherein the frame is telescopically constructed.

* * * * *